US008436783B2

(12) United States Patent
L Eisten

(10) Patent No.: US 8,436,783 B2
(45) Date of Patent: May 7, 2013

(54) DIELECTRICALLY-LOADED ANTENNA

(75) Inventor: Oliver Paul L Eisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 551 days.

(21) Appl. No.: 12/721,097

(22) Filed: Mar. 10, 2010

(65) Prior Publication Data

US 2010/0231480 A1 Sep. 16, 2010

Related U.S. Application Data

(60) Provisional application No. 61/175,694, filed on May 5, 2009.

(30) Foreign Application Priority Data

Mar. 12, 2009 (GB) ..... 0904307.6

(51) Int. Cl.
*H01Q 1/36* (2006.01)

(52) U.S. Cl.
USPC ..... 343/895; 343/850; 343/860; 343/702

(58) Field of Classification Search ..... 343/895, 343/850, 860, 702
See application file for complete search history.

(56) References Cited

U.S. PATENT DOCUMENTS

| | | | | |
|---|---|---|---|---|
| 5,541,617 | A * | 7/1996 | Connolly et al. | 343/895 |
| 6,181,297 | B1 | 1/2001 | Leisten | |
| 6,232,929 | B1 | 5/2001 | Ermutlu et al. | |
| 6,400,339 | B1 | 6/2002 | Edvardsson et al. | |
| 2005/0195126 | A1 * | 9/2005 | Leisten | 343/895 |
| 2006/0022891 | A1 | 2/2006 | O'Neill et al. | |
| 2008/0174501 | A1 | 7/2008 | Licul et al. | |
| 2009/0315806 | A1 | 12/2009 | Leisten et al. | |

FOREIGN PATENT DOCUMENTS

| | | | |
|---|---|---|---|
| FR | 2 814 286 | A1 | 3/2002 |
| GB | 2 292 638 | A | 2/1996 |
| GB | 2 310 543 | A | 8/1997 |
| GB | 2 311 675 | A | 10/1997 |
| GB | 2 367 429 | B | 8/2003 |
| GB | 2 399 948 | B | 9/2004 |
| GB | 2 424 521 | A | 9/2006 |

(Continued)

OTHER PUBLICATIONS

Search Report for Application No. GB 0904307.6 dated Apr. 30, 2009.

(Continued)

*Primary Examiner* — Dieu H Duong
(74) *Attorney, Agent, or Firm* — Alston & Bird LLP

(57) ABSTRACT

A dual-band dielectrically loaded helical antenna for circularly polarised signals has two groups of helical antenna elements. In each group there are at least four such elements and they are connected at their distal ends to a respective feed coupling node and at their proximal ends to a common linking conductor. Each group includes pairs of neighbouring such antenna elements, each pair having one electrically short element and one electrically long element, and the arrangement of the elements is such that in each group the number of pairs in which, in a given direction around the core, the short element precedes the long element is equal to the number of pairs in which, in the same direction, the long element precedes the short element.

14 Claims, 6 Drawing Sheets

FOREIGN PATENT DOCUMENTS

| | | | |
|---|---|---|---|
| GB | 2 444 388 | A1 | 6/2008 |
| GB | 2 445 478 | A | 7/2008 |
| WO | WO 02/23673 | A1 | 3/2002 |
| WO | WO 2004/027930 | A1 | 4/2004 |
| WO | WO 2006/045769 | A1 | 5/2006 |
| WO | WO 2006/136809 | A1 | 12/2006 |

OTHER PUBLICATIONS

International Search Report for Application No. PCT/GB2010/000419 mailed Jun. 29, 2010.
Search Report for Application No. GB 1003910.5 dated Jun. 14, 2010.

* cited by examiner

DIELECTRICALLY-LOADED ANTENNA

CROSS-REFERENCES TO RELATED APPLICATIONS

The present application claims priority from U.S. Provisional Patent Application No. 61/175,694 filed on May 5, 2009, the entire disclosure of which is incorporated herein by reference.

FIELD OF THE INVENTION

This invention relates to a dielectrically-loaded antenna for operation at frequencies in excess of 200 MHz, and primarily but not exclusively to a multi-filar helical antenna for operation with circularly polarised electromagnetic radiation.

BACKGROUND OF THE INVENTION

Dielectrically-loaded quadrifilar helical antennas are disclosed in British Patent Applications Nos. 2292638A, 2310543A, and 2367429A and International Application No. WO2006/136809, the latter being related to U.S. patent application Ser. No. 11/472,586 filed Jun. 21, 2006. Such antennas are intended mainly for receiving circularly polarised signals from a global navigation satellite system (GNSS), e.g. from the satellites of the Global Positioning System (GPS) satellite constellation, for position fixing and navigation purposes. GPS in the L1 band and the corresponding Galileo service are narrowband services. There are other satellite-based services requiring receiving or transmitting apparatus of greater fractional bandwidth than that available from the prior antennas. One antenna offering increased bandwidth is that disclosed in British Patent Application No. 2424521A.

Related antennas are disclosed in British Patent Application No. 2445478A, and related U.S. patent application Ser. No. 11/970,740 filed Jan. 8, 2008. These applications disclose hexafilar and octafilar antennas offering greater bandwidth and/or higher gain than a comparable quadrifilar antenna. A high-impedance quadrifilar antenna is disclosed in British Patent Application No. 3444388A and related U.S. patent application Ser. No. 11/998,471 filed Nov. 28, 2007.

The entire disclosures of the above applications are incorporated in that of the present application as filed, by reference.

It is an object of the present invention to provide an antenna with greater frequency coverage.

SUMMARY OF THE INVENTION

According to a first aspect of this invention, a dielectrically-loaded helical antenna for operation at first and second operating frequencies above 200 MHz and with circularly polarised radiation comprises an electrically insulative dielectric core of a solid material that has a dielectric constant greater than 5 and occupies the major part of the interior volume defined by the core outer surface, a pair of feed coupling nodes, and an antenna element structure that includes a plurality of elongate conductive antenna elements and a common interconnecting conductor, the antenna elements being in the form of elongate conductors distributed around the core on or adjacent the outer surface thereof, wherein the antenna elements comprise a first group of at least four substantially co-extensive antenna elements extending from one of the feed coupling nodes to the common conductor and a second group of at least four substantially co-extensive antenna elements extending from the other feed coupling node to the common conductor, the said groups containing electrically short antenna elements associated with a circular polarisation resonance at the first frequency and electrically long antenna elements associated with a circular polarisation resonance at the second frequency, and wherein each of the said groups includes pairs of neighbouring antenna elements, with each pair comprising one electrically short antenna element and one electrically long antenna element, the arrangement of the elements being such that, in each group, the number of pairs in which, in a given direction around the core, the electrically short antenna element precedes the electrically long antenna element is equal to the number of pairs in which, in the said direction, the electrically long antenna element precedes the electrically short antenna element.

The terms "electrically long antenna elements" and "electrically short antenna elements" are to be construed purely in the comparative rather than absolute sense, in that a group of antenna elements recited as having elements of both such descriptions has elements of different electrical lengths, those described as "electrically long" being electrically longer than those described as "electrically short". The above-recited pairs of neighbouring antenna elements generally include at least three pairs in each of which one of the elements is also an element of another such pair.

Using an antenna of this construction, first and second resonant modes can be provided, each associated with circularly polarised radiation, the first mode being centred on a first, lower frequency and associated with the electrically long elements, and the second mode being centred on a second, higher frequency associated with the electrically short elements. Typically, the spacing between the first and second frequencies is no greater than 12% of the mean of the two frequencies. Each resonant mode is characterised by a rotating dipole, with the voltage maxima being excited on each of the antenna elements in succession in the direction of rotation. The antenna may operate as a dual-band antenna, housing first and second operating frequency bands respectively containing the first and second resonant frequencies. The bands may be separate or may be merged to form a single composite circular polarisation band, depending on the spacing of the resonant frequencies.

The antenna has particular use in handheld and mobile wireless transceivers for satellite telephone services employing neighbouring uplink and downlink frequency bands. Current or projected services include the TerreStar (Registered Trade Mark) S-band service using 2000-2010 MHz and 2190-2200 MHz bands. This is a satellite telephone service that includes an ancillary terrestrial component. Mobile units using these systems typically communicate with satellite and terrestrial stations, the mobile unit automatically switching between one or the other, depending on communication conditions. Other such services lying within the band of from 2000 MHz to 2200 MHz include the ICO global communications S-band service and the SkyTerra service.

The invention also has applicability to dual-service systems combining, for instance, communication with two GNSS systems, e.g., on the one hand, GPS or Galileo on 1575.42 MHz and, on the other hand, Glonass in the band of from 1598.0625 MHz to 1605.9375 MHz. Other feasible combinations using a single antenna in accordance with the invention include the pairing of GNSS on 1575.42 MHz and the Iridium satellite telephone system in the band of from 1616.0 MHz to 1626.5 MHz, and the pairing of, say, two satellite radio services in the band extending from 2320 MHz to 2345 MHz.

Typically, as in antennas in the above-mentioned prior publications, in an antenna in accordance with the invention, the core outer surface has oppositely directed transversely extending end surface portions and a side surface portion (typically a cylindrical surface portion) extending between the end surface portions. The feed coupling nodes are preferably located either on one of the end surface portions or close to an end surface portion (e.g. on the side surface portion adjacent the end surface portion).

The common interconnecting conductor may be a sleeve encircling the core on or adjacent the side surface portion and extending from a location spaced from the feed coupling nodes in the direction of the other end surface portion, to the other end surface portion. Alternatively, it may be a narrow conductive annulus encircling the core, e.g. as an annular track on the side surface portion adjacent the other end surface portion. The antenna elements are preferably connected to the common conductor at substantially uniformly spaced connection points. Similarly, they are preferably substantially uniformly spaced apart around an outer edge of the core end surface portion associated with the feed nodes.

In general, it is preferred that the physical spacing between distal ends of the successive antenna elements in terms of their distribution around the core do not vary by more than 2:1. It is preferred that the same applies to the spacings between proximal ends of the successive antenna elements, and to the spacings between the successive elements at locations between their ends. The annular conductor or the rim of the sleeve to which the co-extensive antenna elements are connected typically lies generally in a plane extending perpendicularly to a central axis of the antenna. It advantageously has an electrical length of 360° (or $\lambda_g$ as the guide wavelength of currents on the conductor or sleeve rim) at or near the frequencies of operation of the antenna, and preferably at the higher frequency referred to above. This means that the interconnecting conductor exhibits a ring resonance at the respective frequency, i.e. at the higher frequency referred to above in the preferred embodiment of the invention.

Again, in common with antennas in the prior publications mentioned above, the co-extensive antenna elements are preferably helical and formed as conductive tracks on the outer surface of the core. In the preferred embodiments of the invention, each helical element executes a half-turn about a central axis of the antenna. It is also possible to use, for instance, full-turn helical elements.

The differences in electrical length between the respective co-extensive antenna elements are advantageously provided by arranging for the electrically short elements to follow a purely helical path and the electrically long elements to follow a path which has a helical mean but which deviates from a pure helix, e.g. in a meandering way. Alternatively, all of the coextensive antenna elements may be meandered about respective pure helical paths but with different meander amplitudes. As another alternative, the differences in electrical length may be obtained by forming the antenna elements as conductive tracks of different widths. In addition, the edge of the common interconnecting conductor to which the antenna elements are joined may be non-planar in the manner described in the above mentioned GB2310543A and GB2445478A. The differences in electrical length between the helical elements yield conductive paths of different electrical lengths between first and second feed nodes, providing respective resonances at different frequencies The applicant has found that a particularly advantageous arrangement of co-extensive antenna elements consists of each of the above-mentioned groups of antenna elements having five co-extensive antenna elements, at least two of which are meandered or otherwise adapted to have a longer electrical length than the other antenna elements of the group. Such an antenna may be viewed as a hybrid combination of (i) a quadrifilar antenna with a circular polarisation resonant mode at the second, lower first frequency and (ii) a hexafilar antenna with a circular polarisation resonant mode at a second frequency, the spacing between the two frequencies being typically between 0.5% and 12% of the mean of the two resonant frequencies.

Whether the antenna has four pairs of coextensive antenna elements, five pairs, or more than five pairs, the antenna elements are preferably substantially uniformly distributed over the side surface portion of the core. Although this means that, in the case of the preferred 10-element antenna, neither the elements of the quadrifilar part nor those of the hexafilar part also referred to above are, in themselves uniformly distributed with respect to each other, they are sufficiently close to a uniform distribution to produce a suitable radiation pattern at each of the required frequencies.

The preferred antenna in accordance with the invention is a backfire antenna, inasmuch as it has feed coupling nodes located on or adjacent a distal end surface portion of the core and a feeder structure passing through the core between the distal end surface portion and an oppositely-directed proximal end surface portion. Optionally, the common interconnecting conductor is coupled to the feeder structure at or near the proximal end surface portion in order to form, in conjunction with the feeder structure, a quarter-wave balun to yield a balanced source at the distal end of the feeder structure, as taught in the prior published applications referred to above. The preferred antenna has an impedance-matching network connected between the feed coupling nodes and the feeder structure, the network including at least one reactive matching element constituted by a conductor or conductors on a laminate board attached to one of the end surface portions of the core, or by means of one or more reactive elements formed by conductors plated on the respective end surface portion or constituted by a discrete, lumped reactive component or components mounted on the end surface portion.

As an alternative to a backfire antenna, the antenna is constructed as an endfire antenna, the feed nodes being located on or adjacent a proximal end surface portion of the core.

According to a second aspect of the invention, a dielectrically-loaded helical antenna having a pair of circular-polarisation resonant modes in neighbouring frequency bands comprises two groups of at least four substantially coaxial and axially co-extensive conductive helical antenna elements with a common radius, a pair of feed coupling nodes and an annular linking conductor, the antenna elements of one of the group extending from one of the feed coupling nodes to the common conductor and those of the other groups extending from the other feed coupling node to the common conductor, characterised in that, in each group, the antenna elements form at least part of respective conductive paths of at least first and second different electrical lengths, one of the pair of resonant modes being associated with the paths of the first electrical length and the other of the pair of resonant modes being associated with the paths of the second electrical length, wherein the pattern formed by the paths is such that the sequence of the different electrical lengths within each group is mirrored about a centre line associated with that group.

In the preferred embodiment, each helical antenna element has a corresponding diametrically opposed elongate element on the other side of the core. Each element of each such pair of elements has a first end coupled to one of the feed nodes and a second end which is linked to the second end of the other elongate antenna element of the pair to form at least part of a respective conductive loop that is generally symmetrical about the axis and that has a predetermined resonant frequency. The loops formed by such pairs of elongate antenna elements are angularly distributed about a central axis of the antenna, the respective resonant frequencies of the loops varying with angular orientation about the axis. The second ends of the elongate antenna elements are linked by the annular linking conductor which encircles the core, such that their second ends are defined by the connections of the elements to a common annular edge of the interconnecting conductor, which edge, in terms of its axial position, varies in height across each of the two groups of elongate antenna elements.

To achieve an appropriate compromise between small size and efficiency over a required bandwidth, it is preferred that the relative dielectric constant of the dielectric core loading the antenna is greater than 10, and, more preferably, greater than 20.

According to a third aspect of the invention, in an antenna as described above, each group of antenna elements has at least two antenna elements of a first electrical length and at least two antenna elements of a different, second electrical length, the resonant modes being centred on first and second respective frequencies between which the frequency spacing is between 2% and 12% of the mean of the first and second frequencies.

In this specification the terms "radiation" and "radiating" are to be construed broadly in the sense that, when applied to characteristics of the antenna or its structure, they include such characteristics or structure associated both with the radiation of energy by the antenna as well as the reciprocal properties of the antenna as a receiving element absorbing energy from its surrounding.

The invention will be described below by way of example with reference to the drawings.

DETAILED DESCRIPTION OF THE PREFERRED EMBODIMENTS OF THE INVENTION

Figure 1:
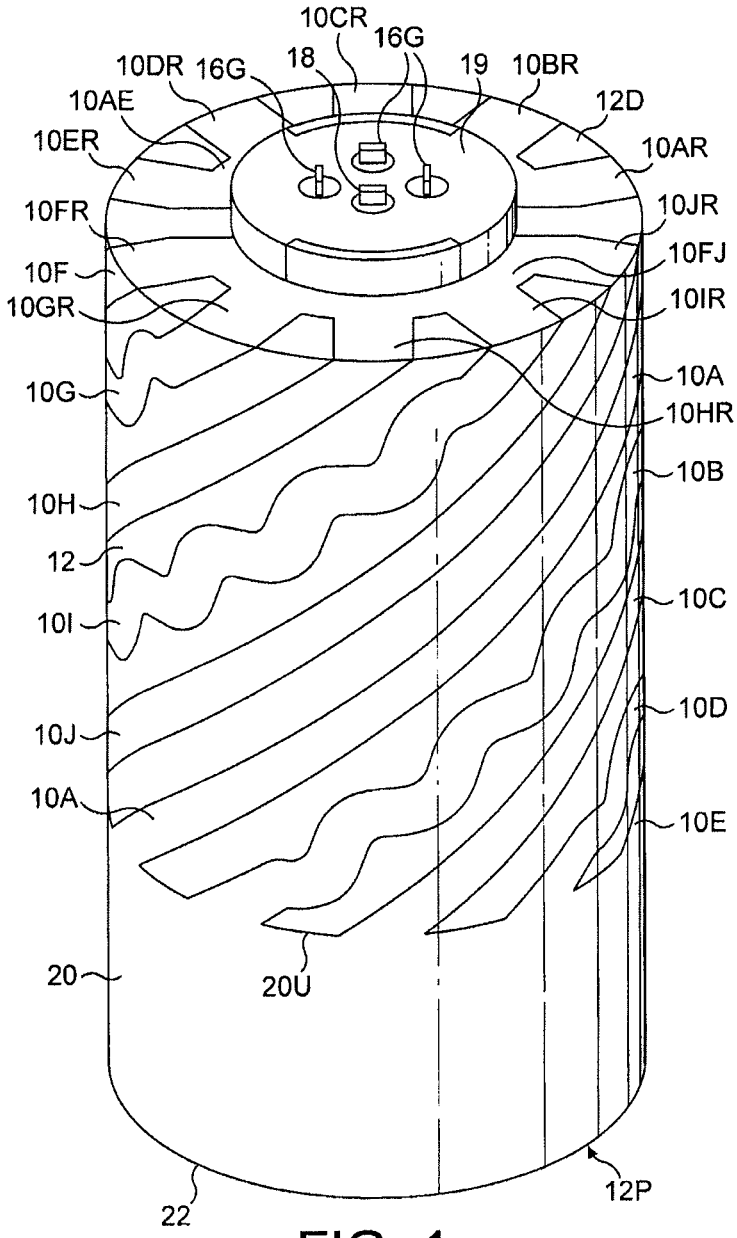
FIG. 1 is a perspective view of an antenna in accordance with the invention.
Figure 2:
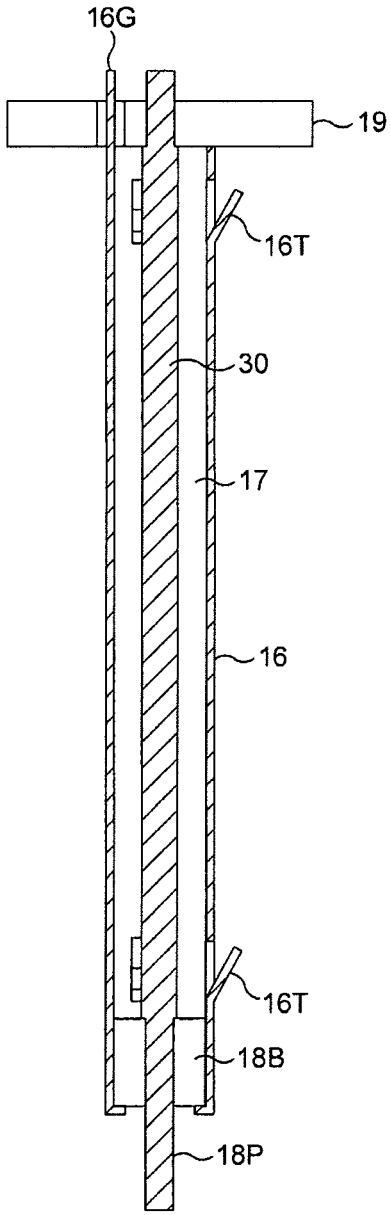
FIG. 2 is an axial cross-section of a feed structure of the antenna of FIG. 1.
Figure 3:
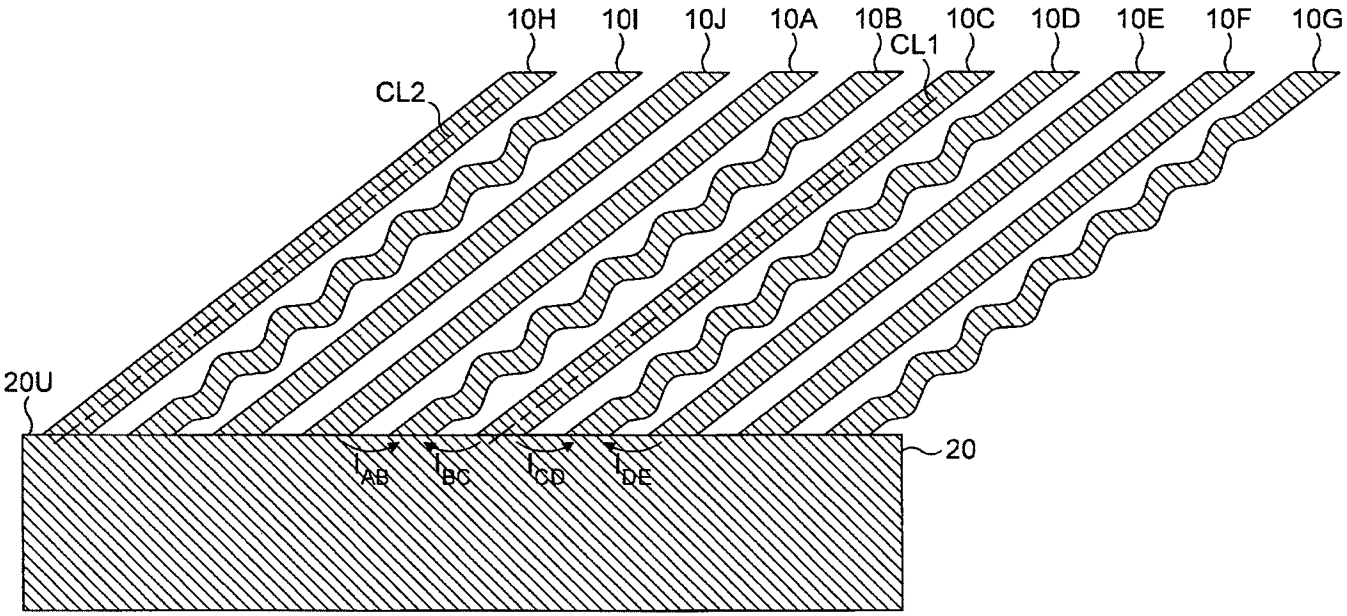
FIG. 3 is a representation of the conductor pattern on the outer cylindrical surface portion of the antenna of FIG. 1, transformed to a plane.

Referring to FIGS. 1, 2 and 3, a dual-band multifilar helical antenna in accordance with the invention has an antenna element structure with ten elongate antenna elements in the form of ten axially coextensive helical conductive tracks 10A, 10B, 10C, 10D, 10E, 10F, 10G, 10H, 10I, 10J plated or otherwise metallised on the cylindrical outer surface of a cylindrical core 12. The core is made of a ceramic material. In this case it is a calcium-magnesium titanate material having a relative dielectric constant in the region of 21. This material is noted for its dimensional and electrical stability with varying temperature, and low dielectric loss. In this embodiment, which is intended for operation at 2100 MHz and 2170 MHz, the core has a diameter of 10 mm. The length of the core, at 17.75 mm, is greater than the diameter but, in other embodiments of the invention, it may be less. The core is produced by pressing, but may be produced in an extrusion process, the core then being fired.

This preferred antenna is a backfire helical antenna in that it has a coaxial transmission line housed in an axial bore that passes through the core from a distal end face 12D to a proximal end face 12P of the core. Both end faces 12D, 12P are planar and perpendicular to the central axis of the core. They are oppositely directed, in that one is directed distally and the other proximally in this embodiment of the invention. The coaxial transmission line is a rigid coaxial feeder which is housed centrally in the bore with the outer shield conductor spaced from the wall of the bore so that there is, effectively, a dielectric layer (in this case an air sleeve) between the shield conductor and the material of the core 12. Referring to FIG. 2, the coaxial transmission line feeder has a conductive tubular outer shield 16, a first tubular air gap or insulating layer 17, and an elongate inner conductor 18 which is insulated from the shield by the insulating layer 17. The shield 16 has outwardly projecting and integrally formed spring tangs 16T or spacers which space the shield from the walls of the bore. A second tubular air gap exists between the shield 16 and the wall of the bore. The insulative layer 17 may, instead, be formed as a plastics sleeve, as may the layer between the shield 16 and the walls of the bore. At the lower, proximal end of the feeder, the inner conductor 18 is centrally located within the shield 16 by an insulative bush (not shown), as described in our above-mentioned WO2006/136809.

The combination of the shield 16, inner conductor 18 and insulative layer 17 constitutes a transmission line of predetermined characteristic impedance, here 50 ohms, passing through the antenna core 12 for coupling distal ends of the antenna elements 10A to 10J to radio frequency (RF) circuitry of equipment to which the antenna is to be connected. The couplings between the antenna elements 10A to 10J and the feeder are made via conductive connection portions associated with the helical tracks 10A to 10J, these connection portions being formed as radial tracks 10AR, 10BR, 10CR, 10DR, 10ER, 10FR, 10GR, 10HR, 10IR, 10JR plated on the distal end face 12D of the core 12. Each connection portion extends from a distal end of the respective helical track to one of two arcuate tracks or conductors 10AE, 10FJ that are plated on the core distal face 12D adjacent the end of the bore 12B and that form feed coupling nodes.

The two arcuate conductors 10AE, 10FJ are coupled, respectively, to the shield and inner conductors 16, 18 by conductors on a printed circuit board (PCB) assembly 19 comprising a laminate board secured to the core distal face 12D, as will described hereinafter. The coaxial transmission line feeder and the PCB assembly 19 together comprise a unitary feed structure before assembly into the core 12, and their interrelationship may be seen by comparing FIGS. 1 and 2.

Referring again to FIG. 2, the inner conductor 18 of the transmission line feeder has a proximal portion 18P which projects as a pin from the proximal face 12P of the core 12 for connection to the equipment circuitry. Similarly, integral lugs (not shown) on the proximal end of the shield 16 project beyond the core proximal face 12P for making a connection with the equipment circuitry ground.

The proximal ends of the antenna elements 10A-10J are interconnected by a common virtual ground conductor 20. In this embodiment, the common conductor is annular and in the form of a plated sleeve surrounding a proximal end portion of the core 12. This sleeve 20 is, in turn, connected to the shield conductor 16 of the feeder by a plated conductive covering 22 of the proximal end face 12P of the core 12.

The ten helical antenna elements 10A-10J constitute five pairs 10A, 10F; 10B, 10G; 10C, 10H; 10I; 10E, 10J of such elements, each pair having one helical element coupled to one of the arcuate conductors 10AE and another element coupled to the other of the arcuate conductors 10FJ and thence, respectively, to the inner conductor 18 and shield 16 of the transmission line feeder. In effect, therefore, the ten helical antenna elements 10A-10J may be regarded as being arranged in two groups of five 10A-10E, 10F-10J, all of the elements 10A-10E of one group being coupled to the first arcuate conductor 10AE and all of the elements 10F-10J of the other group being coupled to the second arcuate conductor 10FJ. Thus, the two arcuate conductors constitute first and second feed coupling nodes that interconnect the respective helical antenna elements, and provide common connections for the elements of each group to one or other of the conductors of the transmission line feeder via a matching network formed on the laminate board 19.

The ten helical antenna elements 10A-10J are of different lengths, as will now be described.

Referring to FIG. 3 in conjunction with FIG. 1, within each group 10A-10E; 10F-10J of antenna elements, there are some antenna elements constituted by purely helical conductor tracks and some constituted by conductor tracks which are generally helical but which follow paths that are meandered about a helical mean and are, therefore, longer than the purely helical tracks. Hereinafter, the meandered tracks and the purely helical tracks are respectively referred to as "long" and "short" tracks. In this embodiment of the invention, there are four long tracks 10B, 10D, 10G, 10I and six short tracks 10A, 10C, 10E, 10F, 10H, 10J. Each track in one of the groups 10A-10E; 10F-10J has a corresponding track of the same length in the other group. Thus, track 10A has a corresponding track 10F of the same length and, for instance, track 10B has a corresponding track 10G. In this way, every helical track has an oppositely located counterpart in the other group, located diametrically opposite in any given plane perpendicular to the axis of the antenna. Each such pair of oppositely located tracks forms part of a respective conductive loop having an effective electrical length of about 360°, each loop running from one of the feed coupling nodes through, firstly, one helical track, via the rim 20U of the sleeve and the other track, and thence to the other feed coupling node. Each such loop has a respective resonant frequency depending on its electrical length. Thus, the loops formed by the long tracks have resonant frequencies which are lower than the loops formed by the short tracks. Since, in this embodiment, there are six short tracks and four long tracks, the antenna can be regarded as a hybrid of a quadrifilar helical antenna having a circularly polarised resonant mode at a first frequency and a hexafilar antenna having a circularly polarised resonant mode at a second frequency which is higher than the first frequency.

In this embodiment, the four long tracks have slightly different lengths by virtue of different amplitudes of meander. Specifically, tracks 10B and 10G have a 350 μm meander amplitude, whilst the other two long tracks 10D, 10I have a smaller meander amplitude, at 300 μm. Having two diametrically opposed tracks 10B, 10G which are slightly longer than the other two tracks of the four long tracks is consistent with the conventional pattern of lengths used in a quadrifilar helical antenna to obtain a circularly polarised radiation pattern directed upwardly along the axis of the antenna. The short elements 10A, 10C, 10E, 10F, 10H, 10J also differ slightly in length, the outer tracks 10A, 10E, 10F and 10J being slightly shorter on the cylindrical surface portion of the core than the central tracks 10C, 10H of each group. This difference in length is achieved by varying the height of the sleeve rim 20U with respect to a perpendicular plane, typically by 200 μm (between the outer and the inner tracks). This variation, in part, is chosen to compensate for the effectively longer path length of the conductors on the distal end face 12D (see FIG. 1) associated with the outer helical tracks 10A, 10E, 10F, 10J.

A phase progression from track to track of the helical tracks 10A-10J is reinforced by the electrical length of the rim 10U of the sleeve 20 being 360° or a single guide wavelength in the frequency region of operation, in this embodiment, at the higher resonant frequency, a ring resonance being excited on the rim 20U.

Excitation of the ring resonance depends in part on there being a net excitation current in a required direction around the rim from the excitation current increments contributed by the elements of each group 10A-10E; 10F-10J. Referring to FIG. 3, it is generally the case that, in the frequency bands of operation, excitation current are generated between "long" and "short" helical elements. Thus, in respect of the helical element group 10A-10E, an excitation current $I_{AB}$ exists between the short track 10A and the long track 10B owing to the relative delay of currents in the long track 10B caused by its greater electrical length. A reverse excitation current $I_{BC}$ exists between the short element 10C and the long element 10B. Similarly, forward and reverse excitation currents are generated on the rim 20U between the next pair 10C, 10D and the following pair 10D, 10E of tracks, as shown in FIG. 3. It will be noted that the excitation currents $I_{AB}$, $I_{BC}$, $I_{CD}$, $I_{DE}$ cancel each other out because there is the same number of current components in a first direction around the rim 20U as there are components in the second, opposite direction. The same pattern of excitation currents exists on the rim 20U where the tracks 10F-10J of the other group meet the rim. Owing to other differences in length, as described above, there is a net excitation current in a single direction around the rim 20U. Thus, there are also excitation currents (not shown) between the long tracks and between the short tracks. However, the excitation currents between neighbouring pairs of long and short elements affect the overall excitation of a ring resonance and, therefore, the cancellation of these particular excitation currents, as described above, is significant.

It follows that, within each group of antenna elements 10A-10E; 10F-10J, the number of pairs of neighbouring elements having, in a given direction around the rim 20U, a short track preceding a long track should be equal to the number of pairs having a long track preceding a short track. In the example described above with reference to FIG. 3, the first group 10A-10E of helical elements has two pairs of neighbouring elements 10A, 10B; 10C, 10D in which, from left to right along the rim 20U, the short track 10A; 10C precedes the long track 10B; 10D and two pairs of neighbouring elements 10B, 10C; 10D, 10E in which the long track 10B; 10D precedes the short track 10C; 10E. In other words, in this embodiment, there are two pairs of neighbouring tracks of differing length exciting current components from left to right and two pairs of neighbouring tracks of differing length exciting current components from right to left, as shown in the drawing. Similarly, there are two pairs of each kind in the other group 10F-10J of elements.

Looked at in a different way, within each group of elements 10A-10E; 10F-10J, there is symmetry of long and short helical tracks about a respective centre line CL1; CL2 of the group.

Another advantageous property of the pattern of the helical antenna elements 10A-10J in this antenna is that the angular spacing at the antenna axis of, firstly the long helical tracks 10B, 10D, 10G, 10I with respect to each other and the short tracks 10A, 10C, 10E, 10F, 10H, 10J with respect to each other is not dissimilar to the ideal uniform spacing of the antenna elements of a quadrifilar antenna and a hexafilar antenna respectively. It will be appreciated that, conventionally, the helical elements of a quadrifilar helical antenna are, in any given plane perpendicular to the axis, spaced at 90° with respect to each other in terms of their angular spacing subtended at the axis. In the present antenna, the long tracks have angular spacings of 72° and 108°, i.e. 18° above and below 90°. The optimum angular spacing for the helical elements of a hexafilar helical antenna is 60°. In the present antenna, angular spacings of 72° are achieved between the short tracks in each group, and 36° between the outermost short elements of the two groups, i.e. 12° above 60° and 24° below 60° respectively.

It will be appreciated that the two advantageous properties described above, i.e. cancellation of excitation currents due to neighbouring pairs of long and short tracks on the one hand, and uniform spacing of long elements and short elements respectively about the axis on the other hand can be achieved with varying degrees of success with different patterns of elements. Other properties are also relevant, such as overall antenna size, track width, and so on. The decafilar antenna described and shown herein is the best compromise currently known to the applicant for an antenna operable in two neighbouring frequency bands in the 1.5 GHz to 2 GHz region.

Each helical track 10A-10J executes substantially a half turn of the core in this antenna, although alternative antennas may employ elements having other integer multiples (2, 3, 4, . . . ) of a half turn.

The conductive sleeve 20, the plating on the proximal end face 12P of the core, and the outer shield 16 of the feeder together form a quarterwave balun that provides common-mode isolation of the radiating antenna element structure from the equipment to which the antenna is connected when installed and when the antenna is operated at its operating frequencies. Currents in the sleeve are, therefore, confined to the sleeve rim 20U. Accordingly, at the operating frequency, the rim 20U of the sleeve 20 and the helical elements of each pair 10A, 10F-10E, 10J form a respective conductive loop connected to a balanced feed, currents travelling between the elements of each pair via the rim 20U.

As stated above, in this preferred embodiment of the invention, the circumference of the sleeve is equal to a guide wavelength at an operating frequency of the antenna. The above-described effect of reinforcing the resonant mode arising from the resonance of the above-mentioned conductive loops formed by the pairs of helical elements and the rim at the operating frequency is described in more detail in British Patent Application No. GB2346014A, the disclosure of which is incorporated herein by reference. The sleeve 20 acts as a resonant structure in itself, independently of the helical elements 10A-10J. Thus, the rim 20U of the sleeve, having an electrical length equal to the operating wavelength, is resonant in a ring mode. Reinforcement of the resonant mode due to the loops formed by the pairs of helical elements and the rim 20U can be visualised by imagining a wave being injected onto the ring represented by the rim 20U at the junction of each of the helical elements and the rim, the wave then travelling around the rim 20U to form a spinning dipole, as described in GB2346014A. Owing to the electrical length of the rim 20U, when the injected wave has traveled around the rim 20U and arrives back at the injection point, the next wave is injected from the respective helical element, thereby reinforcing the first. This constructive combination of waves results from the resonant length of the rim.

Further details of the ring resonance and the action of the sleeve 20 and the plating on the proximal end surface 12P of the core in contributing to the operation of the antenna with regard to circularly polarised electromagnetic waves are contained in the above-mentioned GB2346014A. Whilst the sleeve and plating of this embodiment of the invention are advantageous in that they provide both a balun function and a ring resonance, a ring resonance can also be provided independently by connecting the helical elements 10A-10H to an annular conductor that encircles the core 12 and has both proximal and distal edges on the outer side surface portion of the core, rather than being in the form of a sleeve connected to the feeder shield conductor 16 to form an open-ended cavity, as in the present embodiment. Such a conductor may be comparatively narrow insofar as it may constitute an annular track the width of which is similar to the width of conductive tracks forming the helical elements 10A-10J and, providing it has an electrical length corresponding to the guide wavelength at an operating frequency of the antenna, still produces a ring resonance reinforcing the resonant mode associated with the loops provided by the helical elements and their interconnection.

With regard to the resonant behaviour of the loops represented by the helical elements 10A-10J and their interconnection, these combine such that, at the operating frequencies of the antenna, it operates in modes of resonance in which the antenna is sensitive to circularly polarised signals. Each pair LOAF, 10BG, 10CH, 10DI, 10EJ of the helical elements has an associated resonance within a single operating frequency band of the antenna, and the pairs all co-operate to form a common circular polarisation resonance, as follows. The differing lengths of the antenna elements 10A-10J result in phase differences between currents in the different elements of each group 10A-10E, 10F-10J. In this resonant mode, currents flow around the rim 20U between, on the one hand, the helical element of each pair of elements 10A, 10F; 10B, 10G; 10C, 10H; 10D, 10I; 10E, 10J which is coupled to the inner feed conductor 18 and, on the other hand, that which is connected to the shield 16 by the coupling conductors of the PCB assembly 19 (see FIG. 2), as will be described below. The sleeve 20 and the plating on the proximal end face 12P of the core together act as a trap preventing the flow of currents from the antenna elements 10A-10J to the shield conductor 16 at the proximal end face 12P of the core.

Operation of dielectrically loaded multifilar helical antennas having a balun sleeve is described in more detail in the above-mentioned British Patent Applications Nos. GB2292638A and GB2310543A.

The feeder transmission line performs functions other than simply as a line having a characteristic impedance of 50 ohms for conveying signals to or from the antenna element structure. Firstly, as described above, the shield 16 acts in combination with the sleeve 20 to provide common-mode isolation at the point of connection of the feed structure to the antenna element structure. The length of the shield conductor between (a) its connection with the plating 22 on the proximal end face 12P of the core and (b) its connection to conductors on the PCB assembly 19, together with the dimensions of the axial bore (in which the feeder transmission line is housed) and the dielectric constant of the material filling the space between the shield 16 and the wall of the bore, are such that the electrical length of the shield 16 on its outer surface is, at least approximately, a quarter wavelength at each of the frequencies of the two required modes of resonance of the antenna, so that the combination of the conductive sleeve 20, the plating 22 and the shield 16 promotes balanced currents at the connection of the feed structure to the antenna element structure.

In this preferred antenna, there is an insulative layer surrounding the shield 16 of the feed structure. This layer, which is of lower dielectric constant than the dielectric constant of the core 12, and is an air layer in the preferred antenna, diminishes the effect of the core 12 on the electrical length of the shield 16 and, therefore, on any longitudinal resonance associated with the outside of the shield 16. Since the modes of resonance associated with the required operating frequencies are characterised by voltage dipoles extending diametrically, i.e. transversely of the cylindrical core axis, the effect of the low dielectric constant sleeve on the required modes of resonance is relatively small due to the sleeve thickness being, at least in the preferred embodiment, considerably less than that of the core. It is, therefore, possible to cause the linear mode of resonance associated with the shield 16 to be de-coupled from the wanted modes of resonance.

The antenna has main resonant frequencies of greater than 500 MHz, the resonant frequencies being determined by the effective electrical lengths of the helical antenna elements 10A-10J, as described above. The lengths of the elements, for a given frequency of resonance, are also dependent on the relative dielectric constant of the core material, the dimensions of the antenna being substantially reduced with respect to an air-cored quadrifilar antenna.

The antenna is especially suitable for dual-band satellite communication at about 2 GHz. In this case, the core 12 has a diameter of about 10 mm and the longitudinally extending antenna elements 10A-10D have an average longitudinal extent (i.e. parallel to the central axis) of about 12 mm. The length of the conductive sleeve 20 is typically in the region of 5.5 mm. Precise dimensions of the antenna elements 10A to 10J can be determined in the design stage on a trial and error basis by undertaking empirical optimisation until the required phase differences are obtained. The diameter of the coaxial transmission line in the axial bore of the core is in the region of 2 mm.

Further details of the feed structure will now be described. As shown in FIG. 2, the feed structure comprises the combination of a coaxial 50 ohm line 16, 17, 18 and the PCB assembly 19 connected to a distal end of the line. The laminate board constituting the PCB assembly 19 in this case is a planar multiple-layer printed circuit board that lies flat against the distal end face 12D of the core 12 in face-to-face contact. The largest dimension of the PCB assembly 19 is smaller than the diameter of the core 12 so that the PCB assembly 19 is fully within the periphery of the distal end face 12D of the core 12, as shown in FIG. 1.

Figure 4:
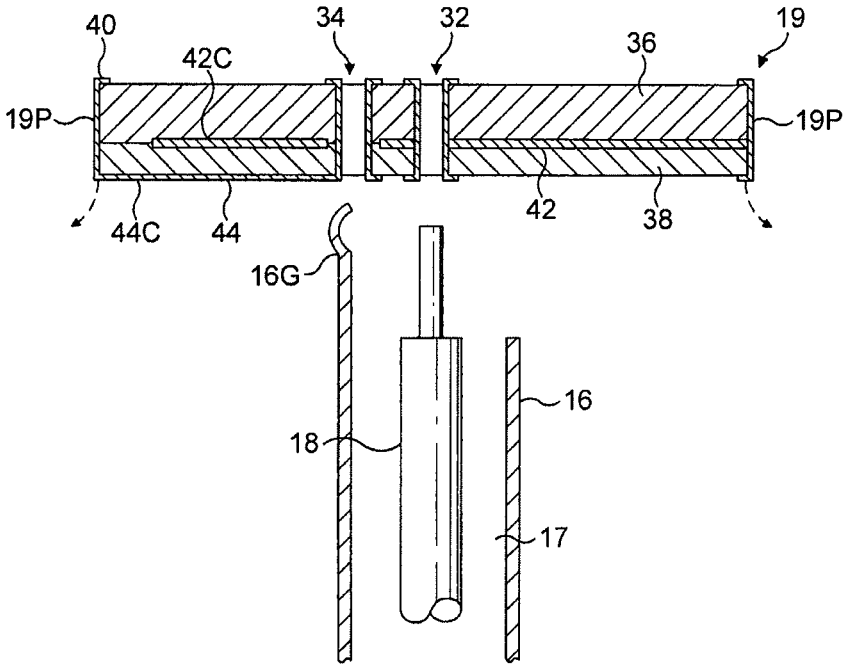
FIG. 4 is a detail of the feed structure shown in FIG. 2, showing a laminate board thereof detached from a distal end portion of a feeder transmission line.

In this embodiment, the PCB assembly 19 is in the form of a disc centrally located on the distal face 12D of the core. Its diameter is such that it overlies the arcuate inter-element coupling conductors 10AE, 10FJ plated on the core distal face 12D. As shown in FIG. 4, the PCB assembly 19 has a substantially central hole 32 which receives the inner conductor 18 of the coaxial feeder transmission line. Three off-centre holes 34 receive distal lugs 16G of the shield 16. Lugs 16G are bent or "jogged" to assist in locating the assembly 19 with respect to the coaxial feeder structure. All four holes 32, 34 are plated through. In addition, portions 19P of the periphery of the PCB assembly 19 are plated, the plating extending onto the proximal and distal faces of the board.

Figure 5A:
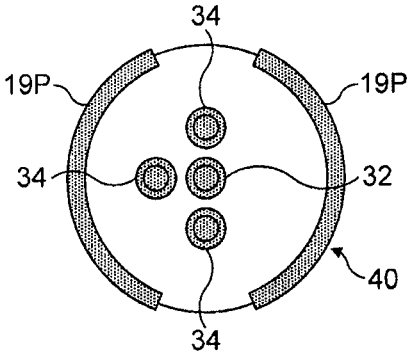
FIGS. 5A, 5B and 5C are diagrams showing conductor patterns of three conductive layers of the laminate board of the feeder structure.
Figure 5B:
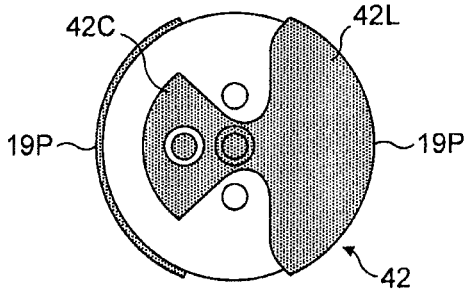
Figure 5C:
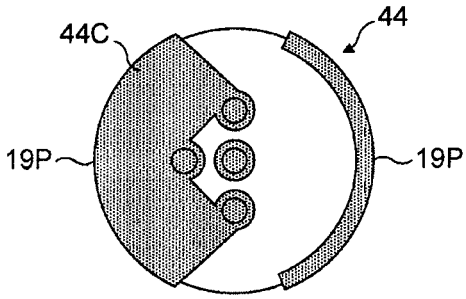

The assembly 19 comprises a multiple-layer board in that it has a plurality of insulative layers and a plurality of conductive layers. In this embodiment, the board has two insulative layers comprising a distal layer 36 and a proximal layer 38. There are three conductor layers as follows: a distal layer 40, an intermediate layer 42, and a proximal layer 44. The intermediate conductor layer 42 is sandwiched between the distal and proximal insulative layers 36, 38, as shown in FIG. 4. Each conductor layer is etched with a respective conductor pattern, as shown in FIGS. 5A to 5C. Where the conductor pattern extends to the peripheral portions 19P of the PCB assembly 19 and to the plated-through holes 32, 34, the respective conductors in the different layers are interconnected by the edge plating and the hole plating respectively. As will be seen from the drawings showing the conductor patterns of the conductor layers 40, 42 and 44, the intermediate layer 42 has a first conductor area 42C in the shape of a fan or sector extending radially from a connection to the inner conductor 18 (when seated in hole 32) in the direction of the radial antenna element connection portions 10AR-10JR. Directly beneath this conductive area 42C, the proximal conductor layer 44 has a generally sector-shaped area 44C extending from a connection with the shield 16 of the feeder (when received in plated via 34) to the board periphery 19P overlying the arcuate or part-annular track 10AE interconnecting the radial connection elements 10AR-10ER. In this way, a shunt capacitor is formed between the inner feeder conductor 18 and the feeder shield 16, the material of the proximal insulative layer 38 acting as the capacitor dielectric. This material typically has a dielectric constant greater than 5.

The conductor pattern of the intermediate conductive layer 42 is such that it has a second conductor area 42L extending from the connection with the inner feeder conductor 18 to the second plated outer periphery 19P so as to overlie the arcuate or part-annular track 10FJ. There is no corresponding underlying conductive area in the conductor layer 44. The conductive area 42L between the central hole 32 and the plated peripheral portion 19P overlying the arcuate track 10FJ acts as a series inductance between the inner conductor 18 of the feeder and one of the groups of helical antenna elements 10F-10J.

When the combination of the PCB assembly 19 and the elongate feeder 16-18 is mounted to the core 12 with the proximal face of the PCB assembly 19 in contact with the distal face 12D of the core, aligned over the arcuate interconnection elements 10AE and 10FJ as described above, connections are made between the peripheral portions 19P and the underlying tracks on the core distal face 12D to form a reactive matching circuit having a shunt capacitance and a series inductance.

The proximal insulative layer of the PCB assembly 19 is formed of a ceramic-loaded plastics material to yield a relative dielectric constant for the layer 38 in the region of 10. The distal insulative layer 36 can be made of the same material or one having a lower dielectric constant, e.g. FR-4 epoxy board, which has a relative dielectric constant of about 4.5. The thickness of the proximal layer 38 is much less than that of the distal layer 36. Indeed, the distal layer 36 may act as a support for the proximal layer 38.

Connections between the feeder line 16-18, the PCB assembly 19 and the conductive tracks on the distal face 12D of the core are made by soldering or by bonding with conductive glue. The feeder 16-18 and the PCB assembly 19 together form a unitary feeder structure when the distal end of the inner conductor 18 is soldered in the via 32 of the PCB assembly 19, and the shield lugs 16G in the respective off-centre vias 34. The feeder 16-18 and the PCB assembly 19 together form a unitary feed structure with an integral matching network.

Figure 6:
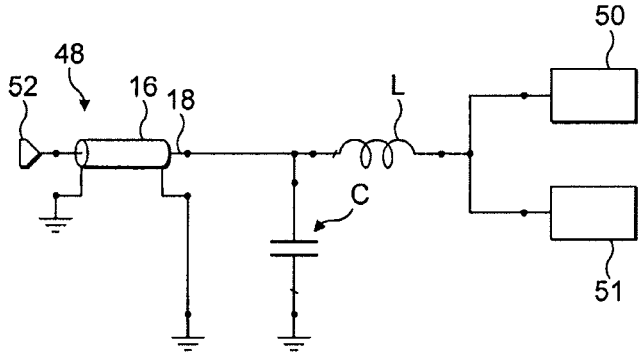
FIG. 6 is an equivalent circuit diagram.

Referring to FIG. 6, the shunt capacitance and the series inductance, shown by C and L in this circuit diagram, form a matching network between the coaxial transmission line 48 at its distal end and the radiating antenna element structure, which appears in the circuit diagram as two sub-circuits 50, 51 representing the antenna elements having short helical tracks 10A, 10C, 10E, 10F, 10H, 10J and long helical tracks 10B, 10D, 10G, 10I respectively (see FIG. 1). The shunt capacitance and the series inductance together match the impedance presented by the coaxial line, physically embodied as shield 16, insulative layer 17 and inner conductor 18, when connected at its proximal end to radiofrequency circuitry having a 50 ohm termination, this coaxial line impedance being matched to the impedance of the antenna element structure at its operating frequencies.

As stated above, the feed structure is assembled as a unit before being inserted in the antenna core 12, the laminate board of the PCB assembly 19 being fastened to the coaxial line 16-18. Forming the feed structure as a single component, including the assembly 19 as an integral part, substantially reduces the assembly cost of the antenna, in that introduction of the feed structure can be performed in two movements: (i) sliding the unitary feed structure into the axial bore of the core 12 and (ii) fitting a conductive ferrule or washer around the exposed proximal end portion of the shield 16. The ferrule may be a push fit on the shield component 16 or is crimped onto the shield. Prior to insertion of the feed structure in the core, solder paste is preferably applied to the connection portions of the antenna element structure on the distal end face 12D of the core 12 and on the plating 22 immediately adjacent the respective ends of the axial bore. Therefore, after completion of steps (i) and (ii) above, the assembly can be passed through a solder reflow oven or can be subjected to alternative soldering processes such as laser soldering, inductive soldering or hot air soldering as a single soldering step.

Solder bridges formed between (a) conductors on the peripheral and the proximal surfaces of the laminate board of the PCB assembly 19 and (b) the metallised conductors on the distal face 12D of the core, and the shapes of the conductors themselves, are configured to provide balancing rotational meniscus forces during reflow soldering when the board is correctly orientated on the core.

Figure 7:
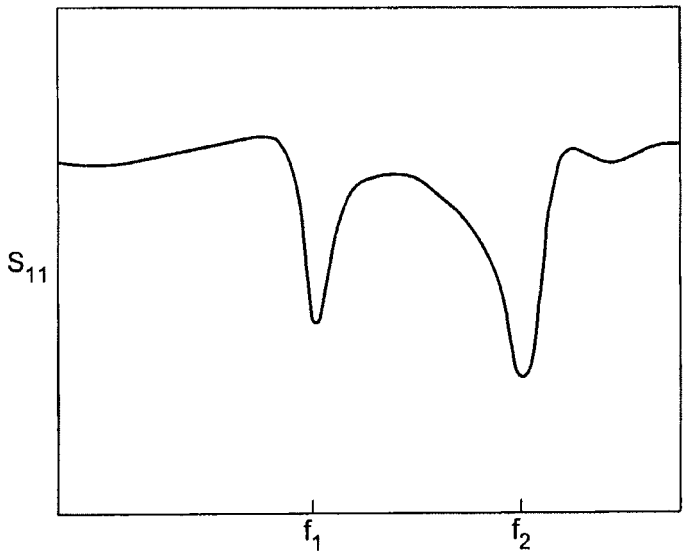
FIG. 7 is a graph illustrating the insertion loss ($S_{11}$) frequency response of the antenna of FIG. 1.

Using the structure described above, it is possible to create a dual-band circularly polarised frequency response, as shown by the insertion loss graph of FIG. 7. The antenna has a first band centred on a lower resonant frequency $f_1$ and a second band centred on an upper resonant frequency $f_2$. Typically, the frequency separation $f_2-f_1$ of the two centre frequencies is between 0.5% and 5% of the mean frequency $\frac{1}{2}(f_1+f_2)$. In the antenna described and shown above, the antenna has a predominantly upwardly directed radiation pattern in respect of left-hand circularly polarised waves.

When the match loci of the unmatched nodes of resonance are insufficiently close together on an impedance Smith chart, a two-pole matching network is preferred. Referring to FIGS. 8, 9A, 9B and 10, an alternative feed structure has a PCB assembly 19 in the form of a double-sided printed circuit board that, as in the previous embodiment, lies flat against the distal end face 12D of the core in face-to-face contact. As before, the printed circuit board has a substantially central hole 32 which receives the inner conductor of the coaxial feeder transmission line, and three off-centre holes 34 receive distal lugs 16G of the shield 16. As before, all four holes 32, 34 are plated through and, in addition, peripheral portions 19PA, 19PB of the board periphery are plated, the plating extending onto both proximal and distal faces of the board.

Figure 8:
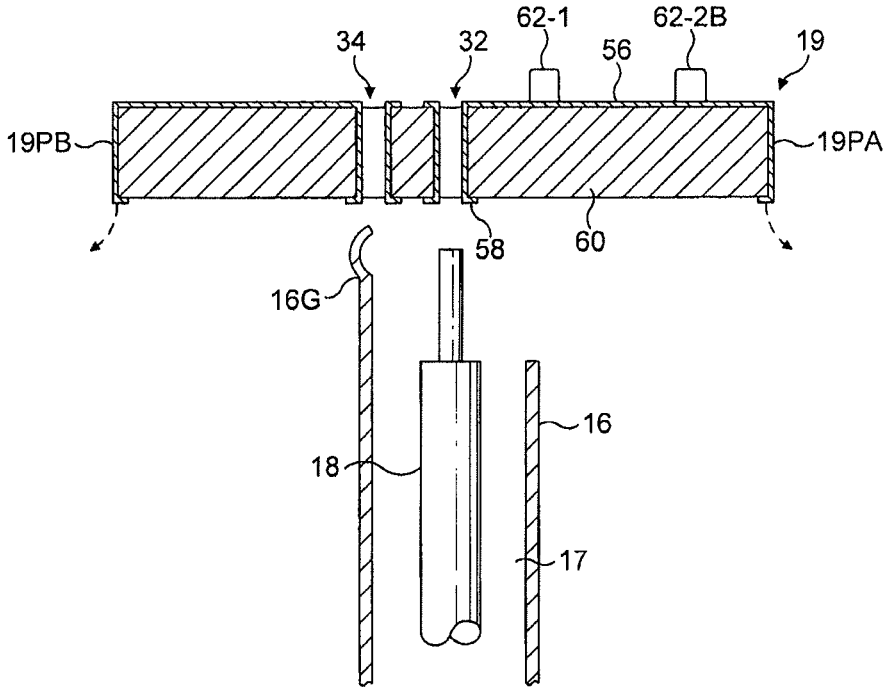
FIG. 8 is a detail of an alternative feed structure.
Figure 9A:
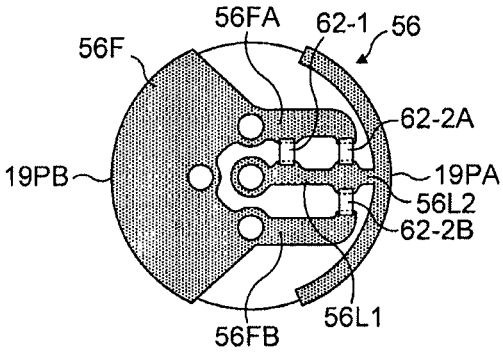
FIGS. 9A and 9B are diagrams showing conductor patterns of two conductive layers of the laminate board of the alternative feed structure shown in FIG. 8.
Figure 9B:
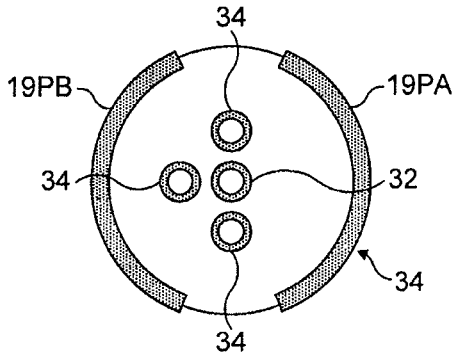

This alternative PCB assembly 19 has a double-sided laminate board in that it has a single insulative layer and two patterned conductive layers. Additional insulative and conductive layers may be used in alternative embodiments of the invention. As shown in FIG. 8, in this embodiment, the two conductive layers comprise a distal layer 56 and a proximal layer 58 which are separated by the insulative layer 60. This insulative layer 60 is made of FR-4 glass-reinforced epoxy board. The distal and proximal conductor layers are each etched with a respective conductor pattern, as shown in FIGS. 9A and 9B respectively. Where the conductor pattern extends to the peripheral portions 19PA, 19PB of the laminate board and to the plated-through holes 32, 34, the respective conductors in the different layers are interconnected by the edge plating and the hole plating respectively. As will be seen from the drawings showing the conductor patterns of the conductor layers 56, 58, the distal conductive layer 56 has an elongate conductor track 56L1, 56L2 that connects the inner feed line conductor 18, when it is housed in the central hole 32 in the laminate board, to a first peripheral plated edge portion 19PA of the board. This elongate track is in two parts 56L1, 56L2 which, owing to their relatively narrow elongate shape constitute inductances at frequencies in operation of the antenna. Since the edge portion 19PA is connected via one 10FJ of the arcuate tracks to half of the radial conductors 10FR-10JR on the distal end face 12D of the core (FIG. 1), these inductances are in series between (i) the inner feed line conductor 18 and (ii) three 10F, 10H, 10J of the antenna elements having short tracks and two 10G, 10I of the helical elements having long tracks. If, in the space available on the laminate board, a single track portion 56L1, 56L2 of sufficient length to yield a required inductance cannot be accommodated, either track portion 56L1, 56L2 can be divided into two parallel track portions, i.e. with a slit between them, to produce a greater inductance per unit length.

The feed line shield 16, when housed in the holes 34 in the laminate board, is connected directly to the opposite peripheral plated edge portion 19PB of the board by a fan-shaped conductor 56F which, owing to its relatively large area, has low inductance. Accordingly, the shield is connected directly to the other antenna elements having short tracks 10A, 10C, 10E and long tracks 10B, 10D via the other arcuate track 10AE and the respective radial conductors 10AR-10ER (FIG. 1).

The fan-shaped conductor 56F is extended towards the first peripheral plated edge portion 19PA alongside the inductive elongate track 56L1, 56L2, to provide pads for discrete shunt capacitances. Accordingly, in this embodiment, the fan-shaped conductor 56F has two extensions 56FA, 56FB running parallel to the inductive track 56L1, 56L2 on opposite sides thereof. Each extension 56FA, 56FB is formed as a track that is much wider and, therefore, of negligible inductance, compared to the central inductive track. One of these extensions 56FA provides pads for a first chip capacitor 62-1 connected to the plating associated with the central hole 32 and a second chip capacitor 62-2A connected to the junction between the two inductive track parts 56L1, 56L2. The other extension 56FB provides a pad for a third chip capacitor 62-2B which is also connected to the junction between inductive track parts 56L1, 56L2. In this embodiment of the invention, the capacitors 62-1, 62-2A, 62-2B are 0201 size chip capacitors (e.g. Murata GJM).

Figure 10:
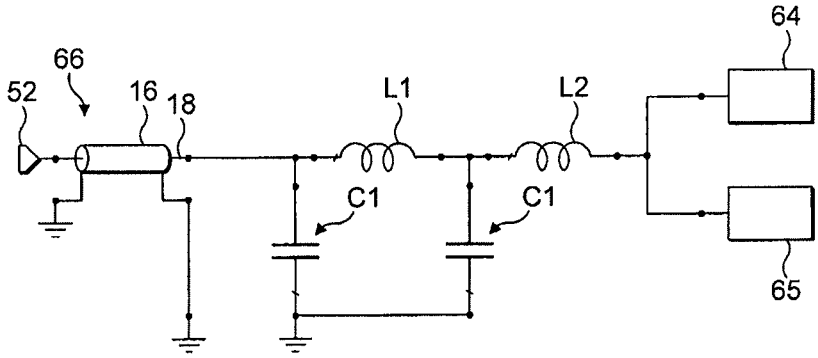
FIG. 10 is another equivalent circuit diagram.

The above-described combination constitutes a two-pole reactive matching network shown schematically in FIG. 10.

The network provides a dual-band match between (a) subcircuits 64, 65 respectively representing the source constituted by the antenna elements having short helical tracks 10A, 10C, 10E, 10F, 10H, 10J and associated parts and the source constituted by the antenna elements having long helical tracks 10B, 10D, 10G, 10I and associated parts, and (b) a 50 ohm load 52. In this example, the feed line 16-18 (FIG. 8) is a 50 ohm coaxial line section 66 Inductors L1 and L2 are formed by the track sections 56L1, 56L2 referred to above. The shunt capacitance C1 is that indicated as capacitor 62-1 in FIGS. 8 and 9A. The other shunt capacitance C2 is formed by the parallel combination of the two chip capacitors 62-2A, 62-2B described above with reference to FIG. 9A. Using two capacitors for the second capacitance C2 allows a relatively high capacitance value to be obtained using low profile chip capacitors and reduces resistive losses.

The network constituted by the series inductances L1, L2 and the shunt capacitances C1, C2 form a matching network between the radiating antenna element structure of the antenna and a 50 ohm termination at the proximal end of the transmission line section when connected to radio frequency circuitry, this 50 ohm load impedance being matched to the impedance of the antenna element structure at its operating frequencies.

What is claimed is:

1. A dielectrically loaded helical antenna for operation at first and second frequencies above 200 MHz and with circularly polarised radiation, wherein the antenna comprises an electrically insulative dielectric core of a solid material that has a dielectric constant greater than 5 and occupies the major part of the interior volume defined by the core outer surface, a pair of feed coupling nodes, and an antenna element structure that includes a plurality of elongate conductive antenna elements and a common interconnecting conductor, the antenna elements being in the form of elongate conductors distributed around the core on or adjacent the outer surface thereof, wherein the antenna elements comprise a first group of at least four substantially co-extensive antenna elements extending from one of the feed coupling nodes to the common conductor and a second group of at least four substantially co-extensive antenna elements extending from the other feed coupling node to the common conductor, the said groups containing electrically short antenna elements associated with a circular polarisation resonance at the first frequency and electrically long antenna elements associated with a circular polarisation resonance at the second frequency, and wherein each of the said groups includes pairs of neighbouring antenna elements, with each pair comprising one electrically short antenna element and one electrically long antenna element, the arrangement of the elements being such that, in each group, the number of pairs in which, in a given direction around the core, the electrically short antenna element precedes the electrically long antenna element is equal to the number of pairs in which, in the said direction, the electrically long antenna element precedes the electrically short antenna element.

2. The antenna according to claim 1, wherein the second frequency is spaced from the first frequency by a frequency difference no greater than 12 percent of the mean of the first and second frequencies.

3. The antenna according to claim 1, wherein the core outer surface has oppositely directed transversely extending end surface portions and a side surface portion extending between the end surface portions, and wherein the feed coupling nodes are located on or close to one of the end surface portions and the common interconnecting conductor is an annular conductor or sleeve encircling the core on or adjacent the side surface portion at a location spaced from the feed coupling nodes in the direction of the other end surface portion.

4. The antenna according to claim 1, having first and second resonant modes each associated with circularly polarised radiation, the first mode being centred on a first frequency and associated with the electrically long elements, and the second mode being centred on a second frequency spaced from the first frequency by a frequency difference no greater than 12 percent of the mean of the first and second frequencies and being associated with the electrically short elements, wherein the core outer surface has oppositely directed transversely extending end surface portions and a side surface portion extending between the end surface portions, and wherein the feed coupling nodes are located on or close to one of the end surface portions and the common interconnecting conductor is an annular conductor or sleeve encircling the core on or adjacent the side surface portion at a location spaced from the feed coupling nodes in the direction of the other end surface portion the electrical length of the common interconnecting conductor being $\lambda_g$ where $\lambda_g$ is the guide wavelength of currents on the conductor at the second frequency.

5. The antenna according to claim 1, wherein the said antenna elements are generally helical and formed as conductive tracks on the outer surface of the core.

6. The antenna according to claim 5, wherein the electrically long antenna elements are meandered about respective pure helices.

7. The antenna according to claim 1, wherein each of the said groups of antenna elements has at least five co-extensive antenna elements.

8. The antenna according to claim 1, in which the core is cylindrical and the said antenna elements are helical and substantially uniformly distributed over the cylindrical outer surface portion of the core.

9. The antenna according to claim 1, constructed as a backfire antenna.

10. The antenna according to claim 9, wherein the feed coupling nodes are located on or adjacent a distal end surface portion of the core and the common interconnecting conductor sleeve encircles the core and is connected at a proximal end surface portion of the core to a feeder structure passing through the core between the distal and proximal end surface portions.

11. The antenna according to claim 1, constructed as an endfire antenna.

12. A dielectrically loaded helical antenna having a pair of neighbouring circular-polarisation resonant modes, wherein the antenna comprises two groups of at least four axially co-extensive conductive helical antenna elements with a common radius, a pair of feed coupling nodes and an annular linking conductor, the antenna elements of one of the groups extending from one of the feed coupling nodes to the common conductor and those of the other groups extending from the other feed coupling node to the common conductor, characterised in that, in each group, the antenna elements form at least part of respective conductive paths of at least first and second different electrical lengths, one of the pair of resonant modes being associated with the paths of the first electrical length and the other of the pair of resonant modes being associated with the paths of the second electrical length, wherein the pattern formed by the paths is such that the sequence of the different electrical lengths within each group is mirrored about a centre line associated with that group, wherein each said group has at least two antenna elements of the first electrical length and at least three antenna elements of the second electrical lenghth.

13. A dielectrically loaded helical antenna having a pair of neighbouring circular-polarisation resonant modes, the antenna having two groups of at least four axially co-extensive conductive helical antenna elements with a common radius, a pair of feed coupling nodes and an annular linking conductor, the antenna elements of one of the groups extending from one of the feed coupling nodes to the common conductor and those of the other groups extending from the other feed coupling node to the common conductor, characterised in that each group of antenna elements has at least two antenna elements of a first electrical length and a least two antenna elements of a different, second electrical length, the resonant modes being centred on first and second respective frequencies between which the frequency spacing is between 2 percent and 12 percent of the mean of the first and second frequencies.

14. The antenna according to claim 13, having at least ten helical antenna elements.

* * * * *

UNITED STATES PATENT AND TRADEMARK OFFICE

CERTIFICATE OF CORRECTION

PATENT NO. : 8,436,783 B2
APPLICATION NO. : 12/721097
DATED : May 7, 2013
INVENTOR(S) : L Eisten It is certified that error appears in the above-identified patent and that said Letters Patent is hereby corrected as shown below:

In the Claims

Column 17,
Claim 12, Line 3, "lenghth" should read --length--.

Signed and Sealed this
Thirteenth Day of August, 2013

Teresa Stanek Rea
*Acting Director of the United States Patent and Trademark Office*